US007360990B2

(12) United States Patent
Barbe et al.

(10) Patent No.: US 7,360,990 B2
(45) Date of Patent: Apr. 22, 2008

(54) METHODS AND APPARATUS FOR ASSEMBLING GAS TURBINE ENGINES

(75) Inventors: Roger Owen Barbe, Cincinnati, OH (US); Mitchell Jay Headley, Lebanon, OH (US); Scott Howard Pelletier, Westchester, OH (US); David N. Rosenow, Fairfield, OH (US)

(73) Assignee: General Electric Company, Schenectady, NY (US)

( * ) Notice: Subject to any disclaimer, the term of this patent is extended or adjusted under 35 U.S.C. 154(b) by 202 days.

(21) Appl. No.: 10/964,303

(22) Filed: Oct. 13, 2004

(65) Prior Publication Data

US 2006/0078420 A1 Apr. 13, 2006

(51) Int. Cl.
*F04D 29/56* (2006.01)

(52) U.S. Cl. ..... 415/160; 415/209.4; 384/296; 384/906

(58) Field of Classification Search ..... 415/159, 415/160, 196, 197, 209.3, 209.4; 384/275, 384/295, 296, 906
See application file for complete search history.

(56) References Cited

U.S. PATENT DOCUMENTS 4,706,354 A * 11/1987 Naudet et al. ..... 29/889.22
5,796,199 A * 8/1998 Charbonnel ..... 310/90
6,474,941 B2 11/2002 Dingwell et al.
6,481,960 B2 * 11/2002 Bowen ..... 415/160
6,682,299 B2 1/2004 Bowen et al.
6,767,183 B2 7/2004 Schilling et al.
6,808,364 B2 10/2004 O'Reilly et al.
6,821,084 B2 11/2004 Bathori et al.
2003/0170115 A1 * 9/2003 Bowen et al. ..... 415/160
2007/0025842 A1 * 2/2007 Bouru ..... 415/160
2007/0059161 A1 * 3/2007 Bouru ..... 415/160

* cited by examiner

*Primary Examiner*—Edward K. Look
*Assistant Examiner*—Nathan Wiehe
(74) *Attorney, Agent, or Firm*—William Scott Andes, Esq.; Armstrong Teasdale LLP

(57) ABSTRACT

A method enables a variable vane assembly for a gas turbine engine including a casing and an inner shroud to be assembled. The method comprises providing at least one variable vane including a radially inner spindle that has a substantially circular cross-sectional shape, and coupling the variable vane radially between the casing and the inner shroud such that the radially inner spindle is rotatably coupled within an opening extending through the inner shroud, wherein the opening has a non-circular cross-sectional profile.

20 Claims, 4 Drawing Sheets

METHODS AND APPARATUS FOR ASSEMBLING GAS TURBINE ENGINES

BACKGROUND OF THE INVENTION

This invention relates generally to gas turbine engines, and more specifically to variable stator vane assemblies used with gas turbine engines.

At least some known gas turbine engines include a core engine having, in serial flow arrangement, a fan assembly and a high pressure compressor which compress airflow entering the engine, a combustor which burns a mixture of fuel and air, and low and high pressure turbines which each include a plurality of rotor blades that extract rotational energy from airflow exiting the combustor. At least some known rotor assemblies, such as a high pressure compressors, include a plurality of rows of circumferentially spaced rotor blades, wherein adjacent rows of rotor blades are separated by rows of variable stator vane (VSV) assemblies. More specifically, a plurality of variable stator vane assemblies are secured to casing extending around the rotor assembly and wherein each row of VSV assemblies includes a plurality of circumferentially-spaced variable vanes. The orientation of each row of vanes relative to the rotor blades is variable to control air flow through the rotor assembly.

At least one known variable stator vane assembly includes a trunnion bushing that is partially positioned around a portion of a variable vane so that the variable vane extends through the trunnion bushing. Each variable vane is coupled radially between the casing and the inner shroud such that the trunnion bushing extends between the casing and a radially outer spindle extending from the vane, and such that an inner bushing extends between the inner shroud and a radially inner spindle extending from the vane. More specifically, and with respect to the radially inner side of the variable vane, the inner shroud is retained to the VSV's by a plurality cylindrical pins extending through a respective hole formed in the inner shroud and into a matching cylindrical groove formed along the radial inner spindle and the inner bushing. Accordingly, only line-to-line contact is established between each pin and each vane, and as such, to prevent the inner shroud form rotating with respect to the variable vanes coupled thereto, two pins must be used per shroud.

Over time, because only line-to-line sealing is defined between each pin and each variable vane, wear between the pins and variable vanes may cause possible gas leakage paths to develop within the VSV assembly. Such leakage may result in failure of the bushing due to oxidation and erosion caused by high velocity high temperature air. Furthermore, once the bushing fails, an increase in leakage past the variable vane occurs, which results in a corresponding rotor performance loss. In addition, the loss of the bushing allows contact between the vane and the casing and/or inner shroud which may cause wear and increase the engine overhaul costs.

BRIEF SUMMARY OF THE INVENTION

In one aspect, a method for assembling a variable vane assembly for a gas turbine engine including a casing and an inner shroud is provided. The method comprises providing at least one variable vane including a radially inner spindle that has a substantially circular cross-sectional shape, and coupling the variable vane radially between the casing and the inner shroud such that the radially inner spindle is rotatably coupled within an opening extending through the inner shroud, wherein the opening has a non-circular cross-sectional profile.

In another aspect, a variable vane assembly for a gas turbine engine including a casing is provided. The variable vane assembly includes a variable vane and an inner shroud. The variable vane includes a radially inner spindle and a radially outer spindle. The radially inner and outer spindles are configured to rotatably couple the vane within the gas turbine engine. The radially inner spindle includes a first cross-sectional shape defined by an external surface of the radially inner spindle. The inner shroud includes a radially outer surface, a radially inner surface, and at least one opening extending therebetween. The radially inner spindle is sized for insertion through the opening for rotatably coupling the variable vane to the inner shroud. The opening is defined by an inner wall and has a second cross-sectional profile that is different than the inner spindle first cross-sectional profile.

In a further aspect, a gas turbine engine is provided. The engine includes a rotor, a casing, and a variable vane assembly. The rotor includes a rotor shaft and a plurality of rows of rotor blades. The casing surrounding each of the plurality of rows of rotor blades. The variable vane assembly includes at least one row of circumferentially-spaced variable vanes and a retainer assembly. The at least one row of variable vanes is rotatably coupled to the casing and extends between an adjacent pair of the plurality of rows of rotor blades. Each of the variable vanes includes a radially inner spindle that is configured to rotatably couple to an inner shroud within the gas turbine engine. Each radially inner spindle has a first cross-sectional shape defined by an external surface of the radially inner spindle. The shroud includes a radially outer surface, a radially inner surface, and at least one opening extending therebetween. The shroud opening is defined by an inner wall and has a second cross-sectional shape that is different than each said inner spindle first cross-sectional shape.

DETAILED DESCRIPTION OF THE INVENTION

Figure 1:
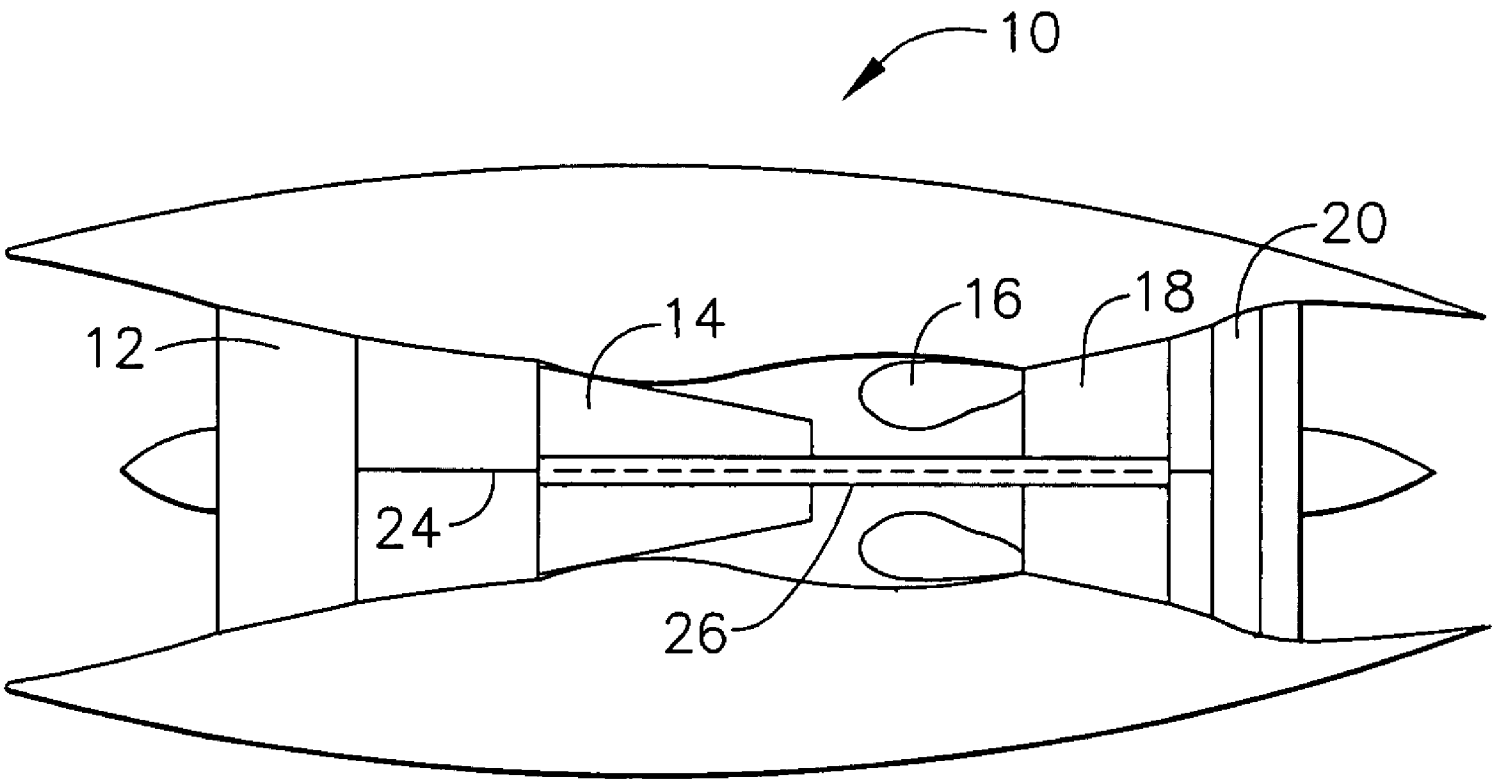
FIG. 1 is schematic illustration of a gas turbine engine.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20. Compressor 12 and turbine 20 are coupled by a first shaft 24, and compressor 14 and turbine 18 are coupled by a second shaft 26. In one embodiment, the gas turbine engine is a CF6 available from General Electric Company, Cincinnati, Ohio.

In operation, air flows through low pressure compressor 12 and compressed air is supplied from low pressure compressor 12 to high pressure compressor 14. The highly compressed air is delivered to combustor 16. Airflow from combustor 16 drives turbines 18 and 20 before exiting gas turbine engine 10.

Figure 2:
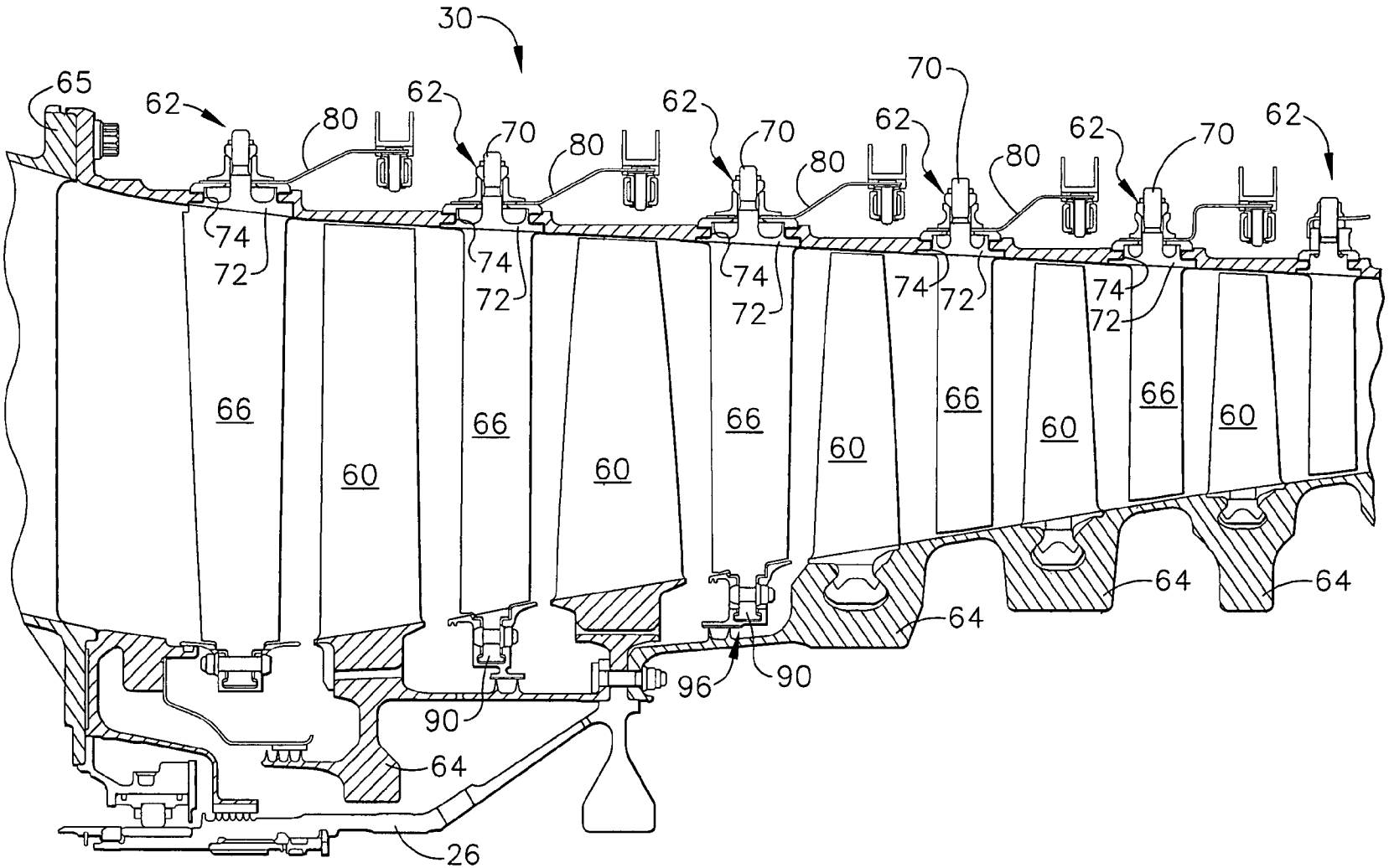
FIG. 2 is partial schematic view of an exemplary gas turbine engine rotor assembly.
Figure 3:
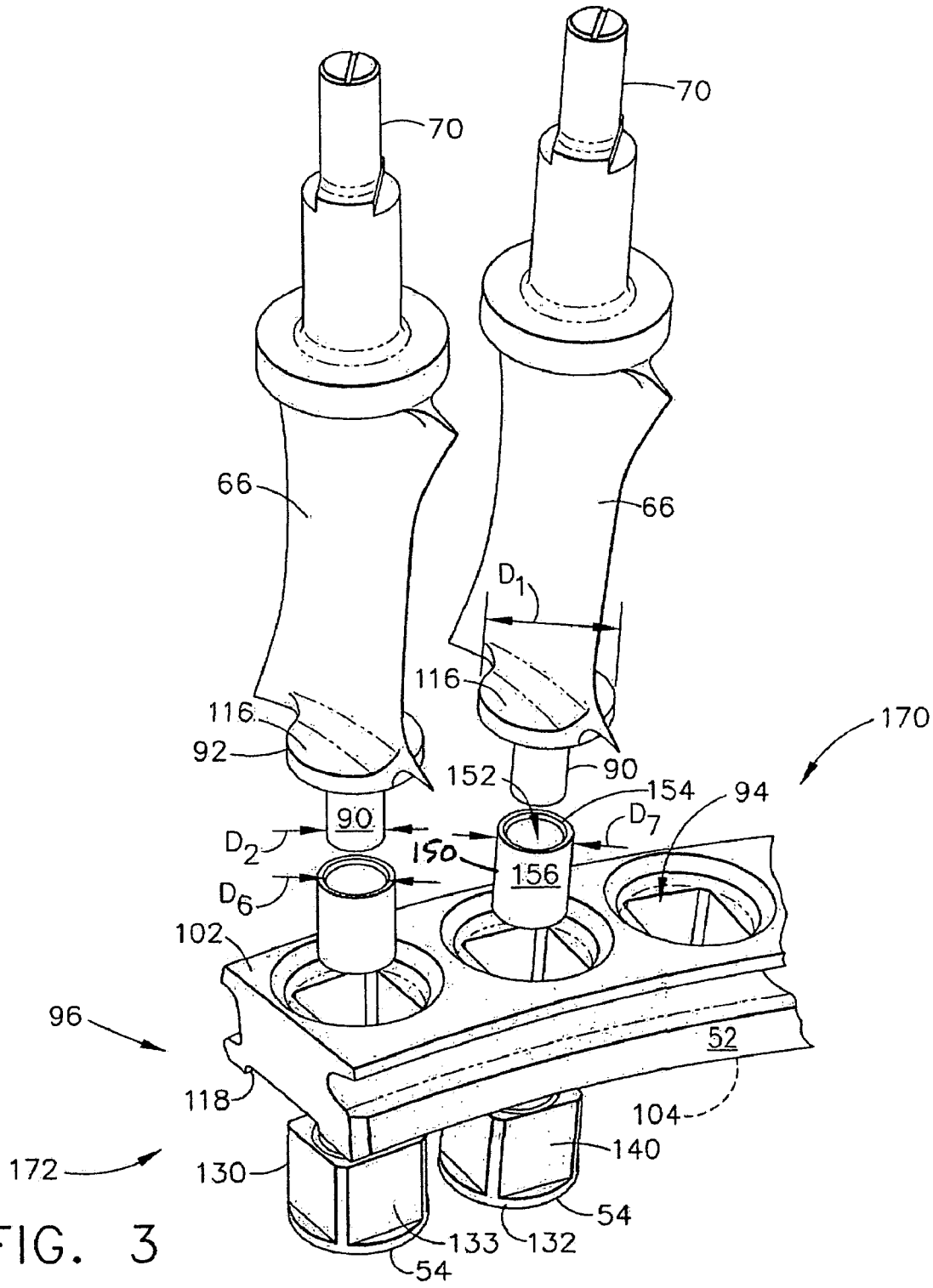
FIG. 3 is an enlarged exploded view of a portion of a variable stator vane assembly shown in FIG. 2.
Figure 4:
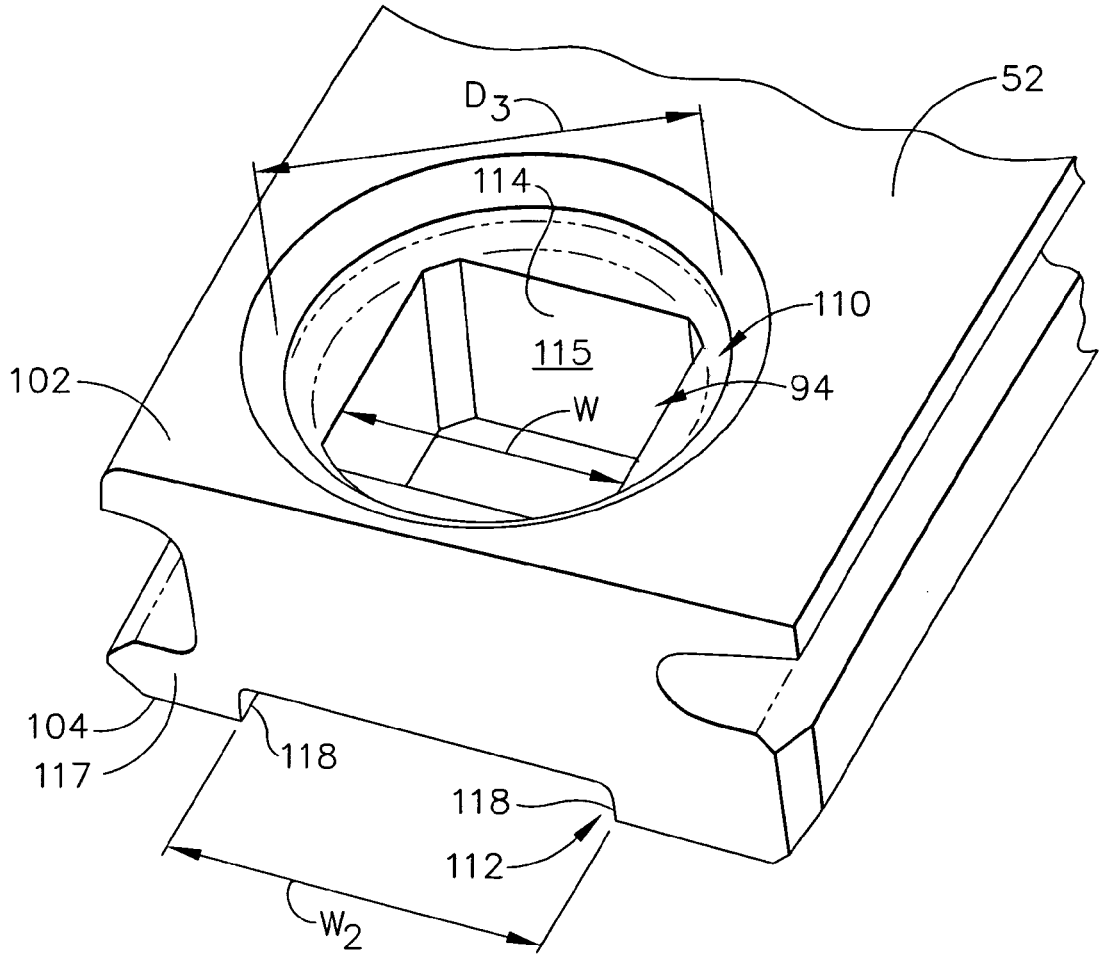
FIG. 4 is an enlarged perspective view of a portion of an inner shroud used with the variable vane assembly shown in FIG. 3.
Figure 5:
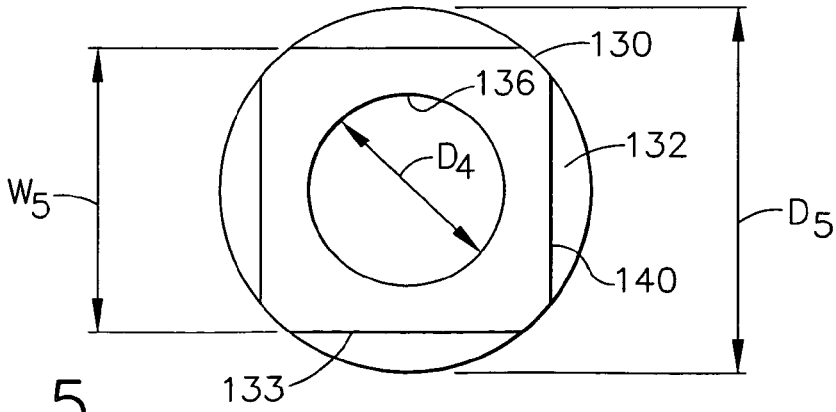
FIG. 5 is a plan view of a bushing used with the variable vane assembly shown in FIG. 3.

FIG. 2 is partial enlarged schematic view of a gas turbine engine rotor assembly 30, such as compressor 14. FIG. 3 is an enlarged exploded view of a portion of a variable stator vane assembly 62 used with rotor assembly 30. FIG. 4 is an enlarged perspective view of a portion of an inner shroud 52 used with variable vane assembly 62. FIG. 5 is a plan view of a bushing 54 used with variable vane assembly 62. Rotor assembly 30 includes a plurality of stages, and each stage includes a row of rotor blades 60 and a row of variable stator vane (VSV) assemblies 62. In the exemplary embodiment, rotor blades 60 are supported by rotor disks 64 and are coupled to rotor shaft 26. Rotor shaft 26 is surrounded by a casing 65 that extends circumferentially around compressor 14 and supports variable stator vane assemblies 62.

Each variable stator vane assembly 62 includes a variable vane 66 that includes a radially outer vane stem or spindle 70 that extends substantially perpendicularly from a vane platform 72. More specifically, each vane platform 72 extends between a respective variable vane 66 and spindle 70. Each spindle 70 extends through a respective opening 74 defined in casing 65 to enable each variable vane 66 to be rotatably coupled to casing 65. Casing 65 includes a plurality of openings 74. A lever arm 80 extends from each variable vane 66 and is utilized to selectively rotate variable vanes 66 for changing an orientation of vanes 66 relative to the flow path through compressor 14 to facilitate increased control of air flow through compressor 14.

Each variable stator vane 66 also includes a radially inner vane stem or spindle 90 that extends substantially perpendicularly from a radially inward vane platform 92. In the exemplary embodiment, each spindle 90 is cylindrical and has a substantially circular cross-sectional profile. More specifically, vane platform 92 extends between variable vane 66 and spindle 90, and has an outer diameter $D_1$ that is larger than an outer diameter $D_2$ of each radially inner spindle 90. As described in more detail below, each spindle 90 extends through a respective opening 94 defined in an inner shroud assembly 96.

In the exemplary embodiment, shroud assembly 96 is formed from a plurality of arcuate shroud segments 52 that abut together such that shroud assembly 96 extends substantially circumferentially within engine 10. In an alternative embodiment, shroud assembly 96 is formed from an annular shroud member. Each shroud segment 52 includes a plurality of circumferentially-spaced stem openings 94 that extend radially through shroud segment 52 between a radially outer surface 102 and a radially inner surface 104 of shroud segment 52.

In the exemplary embodiment, each shroud segment stem opening 94 includes an outer recessed portion 112, an inner recessed portion 110, and a spindle body portion 114 extending therebetween. Inner recessed portion 110 is sized such that when vane 66 is rotatably coupled within opening 94, spindle 90 extends at least partially through opening 94, and a radial outer surface 116 of each vane platform 92 is substantially flush with shroud segment radial outer surface 102. Accordingly, recessed portion 110 has a cross-sectional profile that is substantially similar to that of platform 92, and thus, in the exemplary embodiment, recessed portion 110 has a substantially circular cross-sectional profile. Accordingly, in the exemplary embodiment, recessed portion 110 has a diameter $D_3$ that is slightly larger than vane platform diameter $D_1$.

In the exemplary embodiment, outer recessed portion 112 extends between opposed circumferential ends 117 of each shroud segment 52. Accordingly, when shroud assembly 96 is fully assembled, outer recessed portion 112 extends substantially circumferentially within shroud assembly 96. In the exemplary embodiment, outer recessed portion 112 is bordered by a pair of opposed sidewalls 118 that extend across shroud segment 52 between ends 117, such that a generally rectangular channel extends across shroud segment 52.

Opening spindle body portion 114 extends between recessed portions 110 and 112 and is sized to receive spindle 90 therethrough. More specifically, in the exemplary embodiment, opening portion 114 has a substantially square cross-sectional area that has a width W. Width W is measured with respect to an inner sidewall 115 and is wider than spindle outer diameter $D_2$, and is narrower than recessed opening diameter $D_3$. Moreover, opening portion width W is also narrower than a corresponding width $W_2$ of outer recessed portion 112.

Outer recessed portion 112 is sized to receive a portion of bushing 54 therein, such that bushing 54 is aligned substantially concentrically within opening 94 and with respect to spindle 90. More specifically, when variable vane 66 is secured to inner shroud assembly 96, at least a portion of bushing 54, described in more detail below, circumscribes spindle 90 and extends between spindle 90 and opening sidewall 115. More specifically, bushing 54 includes a shank portion 130 and a cap portion 132. Shank portion 130 is formed of an annular sidewall 133 that extends substantially perpendicularly from cap portion 132. In an alternative embodiment, shank portion sidewall 133 is formed from a plurality of wall segments. In another alternative embodiment, sidewall 133 extends obliquely from cap portion 132.

In the exemplary embodiment, bushing 54 is fabricated from a metallic material, and each shroud segment 52 is fabricated from a wear-resistant material that has relatively low wear and frictional properties. For example, in one embodiment, bushing 54 is fabricated from, but is not limited to being fabricated from, a metallic material or a polyimide material such as, but not limited to Vespel.

Bushing shank portion 130 is hollow and includes an opening 136 that extends through shank portion 130 and cap portion 132. In the exemplary embodiment, opening 136 is substantially circular and has a diameter $D_4$ measured with respect to sidewall 133. Opening diameter $D_4$ is larger than spindle outer diameter $D_2$, and thus, opening 136 is sized to receive at least a portion of spindle 90 therein.

An exterior surface 140 of shank portion sidewall 133 defines a substantially square cross-sectional profile for shank portion 130. More specifically, shank portion 130 has a width $W_5$ that is slightly smaller than opening spindle body portion width W. Accordingly, shank portion 130 is sized to be slidably coupled within shroud opening 94. Moreover, because shank portion 130 has an outer cross-sectional profile defined by surface 140 that is substantially similar to that defined by that of opening spindle body portion 114, the cross-sectional shape of opening 94 and shroud opening sidewall 115 facilitate orienting bushing 54 with respect to shroud assembly 96 and with respect to variable vane assembly 62. Moreover, as described in more detail below, the combination of the cross-sectional shape of shank portion 130 and the cross-sectional shape of opening 94 facilitate preventing rotation of bushing 54 within opening 94 and with respect to shroud assembly 96.

In the exemplary embodiment, bushing cap portion 132 has a substantially circular cross-sectional profile and has a diameter $D_5$. Bushing cap diameter $D_5$ is narrower than a width $W_2$ of recessed portion 112. Accordingly, when bushing 54 is coupled to shroud assembly 96, shank portion 130 is received within shroud opening 94 and cap 132 is received within recessed portion 112 such that an outer surface 140 of bushing cap portion 132 is substantially flush with shroud inner surface 104. More specifically, when bushing 54 is coupled to shroud segment 52, shank portion 130 extends circumferentially around spindle 90 between spindle 90 and opening sidewall 115.

In the exemplary embodiment, stator vane assembly 62 includes a substantially cylindrical wear sleeve 150. In an alternative embodiment, stator vane assembly 62 does not include wear sleeve 150. Wear sleeve 150 is hollow and includes an opening 152 extending therethrough. Opening 152 has a diameter $D_6$ measured with respect to an inner surface 154 of sleeve 150 that is larger than spindle outer diameter $D_2$. Moreover, sleeve 150 has an outer diameter $D_7$ measured with respect to an outer surface 156 of sleeve 150 that is smaller than bushing opening diameter $D_4$. Accordingly, when sleeve 150 is inserted within shroud opening 94, wear sleeve extends circumferentially around spindle 90 and is positioned between bushing shank portion 130 and spindle 90, and shank portion 130 extends circumferentially around spindle 90 between spindle 90 and opening sidewall 115.

During assembly of vane assembly 62, initially wear sleeve 150 is slidably coupled to spindle 90 and variable vane radially inner spindle 90 is then inserted through a respective shroud segment stem opening 94 from a radially outer side 170 of shroud segment 52 towards a radially inner side 172 of shroud segment 52. When seated within opening 94, vane platform 92 is rotatably coupled within opening recessed portion 110 such that platform radial outer surface 116 is substantially flush with shroud radial outer surface 102.

Bushing 54 is then inserted from shroud segment radially inner side 172 into the same segment opening 94 such that bushing shank portion 130 extends around vane spindle 90 and between spindle 90 and shroud segment opening sidewall 115. More specifically, when bushing 54 is fully inserted within opening 94, bushing body shank portion 130 circumscribes spindle 90, and bushing cap portion 132 is received within recessed portion 112. Moreover, when fully seated within opening 94, bushing 54 is substantially concentrically aligned with respect to shroud opening 94 and spindle 90.

During operation, the cross-sectional shape of shroud opening 94 prevents rotation of bushing 54 and more specifically, prevents bushing shank portion 130 from rotating within opening 94. Accordingly, pressure forces acting on shroud assembly 96 are induced to bushing 54 and to wear sleeve 150 such that the flat exterior surfaces 140 of bushing shank portion sidewall 133, such that relative motion between bushing 54 and each shroud segment 52 is facilitated to be minimized. Accordingly, bushing 54 and/or wear sleeve 150 facilitates extending a useful life of variable vane assembly 62. Moreover, generally, if relative motion does occur, wear sleeve 150 provides additional shielding to facilitate preventing wear to vane assembly 62. As a result, engine overhaul costs will be facilitated to be reduced.

The above-described variable vane assemblies are cost-effective and highly reliable. The VSV assembly includes a variable vane that includes a circular spindle that is received within a square-shaped opening. A bushing having a square-shaped external shape is inserted within the shroud opening such that the spindle is received within a circular opening formed in the bushing. Accordingly, wear generated between the shroud and the vane is reduced. As a result, the bushing and/or wear sleeve facilitate extending a useful life of the VSV assembly in a cost-effective and reliable manner.

Exemplary embodiments of VSV assemblies are described above in detail. The systems are not limited to the specific embodiments described herein, but rather, components of each assembly may be utilized independently and separately from other components described herein. Each bushing and/or shroud component can also be used in combination with other VSV components and with other configurations of VSV assemblies.

While the invention has been described in terms of various specific embodiments, those skilled in the art will recognize that the invention can be practiced with modification within the spirit and scope of the claims.

What is claimed is:

1. A method for assembling a variable vane assembly for a gas turbine engine including a casing and an inner shroud, said method comprising:

providing at least one variable vane including a radially inner spindle that has a substantially circular cross-sectional shape;

coupling the variable vane radially between the casing and the inner shroud such that the radially inner spindle is rotatably coupled within an opening extending through the inner shroud, wherein the opening has a first recessed portion, a second recessed portion and a third opening portion that extends from the second recessed portion to the first recessed portion wherein the third opening portion has a non-circular cross-sectional profile defined by a continuous wall, wherein the first recessed portion, the second recessed portion, and the third opening portion extend along an axis parallel to an axis of the variable vane; and slidably coupling a bushing into the shroud opening such that the bushing receives a portion of the radially inner spindle therein, wherein the bushing includes a portion having non-circular cross-sectional shape that is inserted through the second portion opening and is sized to be received within the third opening portion, and a base portion having a circular cross-sectional shape sized to be received within the second recessed portion, such that an outer end surface of the base portion is substantially flush with said shroud radially inner surface.

2. A method in accordance with claim 1 wherein the bushing includes a substantially circular opening extending at least partially therethrough and has a non-circular cross-sectional shape defined at its perimeter by a continuous outer surface of the bushing.

3. A method in accordance with claim 1 wherein slidably coupling a bushing into the shroud opening further comprises slidably coupling the bushing in the shroud opening to facilitate reducing wear of the variable vane.

4. A method in accordance with claim 1 further comprising inserting a substantially cylindrical wear sleeve between the radially inner spindle and the bushing.

5. A method in accordance with claim 1 further comprising slidably coupling a substantially cylindrical wear sleeve to the radially inner spindle to facilitate reducing wear of the radially inner spindle.

6. A variable vane assembly for a gas turbine engine including a casing, said variable vane assembly comprising:

a variable vane comprising a radially inner spindle and a radially outer spindle, said radially inner and outer spindles configured to rotatably couple said vane within the gas turbine engine, said radially inner spindle comprises a first cross-sectional shape defined by an external surface of said radially inner spindle;

an inner shroud comprising a radially outer surface, a radially inner surface, and at least one opening extending between said radially outer and inner surfaces, said radially inner spindle sized for insertion through said opening for rotatably coupling said variable vane to said inner shroud, said opening comprises a first recessed portion, a second recessed portion and a third opening portion that extends from said second recessed portion to said first recessed portion, said third opening portion has a non-circular cross-sectional profile defined by a continuous wall that extends from said first recessed portion to said second recessed portion, wherein said first recessed portion, said second recessed portion and said second cross-sectional profile extend along an axis parallel to an axis of said variable vane; and a bushing comprising a non-circular cross-sectional shape portion sized to be received within a portion of said opening, a base portion having a circular cross-sectional shape sized to be received within the second recessed portion, such that an outer end surface of the base portion is substantially flush with said shroud radially inner surface, and an opening sized to receive a portion of said radially inner spindle therein.

7. A variable vane assembly in accordance with claim 6 wherein said bushing is sized for insertion within said inner shroud opening such that said bushing extends circumferentially around said radially inner spindle within said opening.

8. A variable vane assembly in accordance with claim 6 wherein said bushing is configured to facilitate reducing wear of said variable vane.

9. A variable vane assembly in accordance with claim 6 wherein said bushing comprises an outer surface, an inner surface, and an opening extending therethrough, said opening defined by said bushing inner surface and having a cross-sectional shape that is different than a cross-sectional shape of said bushing as defined by said bushing outer surface.

10. A variable vane assembly in accordance with claim 9 wherein said bushing outer surface cross-sectional shape is substantially similar to that of said inner shroud opening second cross-sectional profile such that said bushing is slidably coupled within said inner shroud opening.

11. A variable vane assembly in accordance with claim 9 wherein said bushing opening cross-sectional shape is substantially similar to that of said inner spindle first cross-sectional profile.

12. A variable vane assembly in accordance with claim 6 further comprising a cylindrical wear sleeve slidably coupled to and extending circumferentially around said radially inner spindle.

13. A variable vane assembly in accordance with claim 12 wherein said wear sleeve is hollow and has an outer diameter that is smaller than a diameter of said bushing opening, and an inner diameter that is larger than a diameter of said radially inner spindle.

14. A gas turbine engine comprising:

a rotor comprising a rotor shaft and a plurality of rows of rotor blades;

a casing surrounding each of said plurality of rows of rotor blades;

a variable vane assembly comprising at least one row of circumferentially-spaced variable vanes and a retainer assembly, said at least one row of variable vanes rotatably coupled to said casing and extending between an adjacent pair of said plurality of rows of rotor blades, each said variable vane comprising a radially inner spindle configured to rotatably couple to an inner shroud within said gas turbine engine, each said radially inner spindle comprises a first cross-sectional shape defined by an external surface of said radially inner spindle, said shroud comprising a radially outer surface, a radially inner surface, and at least one opening extending therebetween, said opening comprising a first recessed portion, a second recessed portion and a third opening portion that extends from said second recessed portion to said first recessed portion, said third opening portion has a non-circular cross-sectional profile defined by a continuous wall that extends from said first recessed portion to said second recessed portion, wherein said first recessed portion, said second recessed portion, and said second cross-sectional profile extend along an axis parallel to an axis of said variable vane; and a bushing comprising a non-circular cross-sectional shape portion sized to be received within a portion of said opening, a base portion having a circular cross-sectional shape sized to be received within the second recessed portion, such that an outer end surface of the base portion is substantially flush with said shroud radially inner surface, and an opening sized to receive a portion of said radially inner spindle therein.

15. A gas turbine engine in accordance with claim 14 wherein said inner shroud extends substantially circumferentially between each adjacent pair of said plurality of rows of rotor blades, and wherein said bushing is sized for insertion within said inner shroud opening to facilitate reducing wear of said variable vane.

16. A gas turbine engine in accordance with claim 14 wherein said bushing extends circumferentially around said radially inner spindle within said inner shroud opening.

17. A gas turbine engine in accordance with claim 14 wherein said bushing comprises an outer surface, an inner surface, and an opening extending therebetween, said bushing opening has a cross-sectional shape defined by said bushing inner surface that is different than a cross-sectional shape defined by said bushing outer surface.

18. A gas turbine engine in accordance with claim 14 wherein said bushing outer cross-sectional shape is substantially similar to that of said inner shroud opening cross-sectional shape such that said bushing is slidably coupled within said inner shroud opening.

19. A gas turbine engine in accordance with claim 14 wherein said variable vane assembly further comprises a wear sleeve slidably coupled to said radially inner spindle to facilitate extending a useful life of said variable vane assembly.

20. A gas turbine engine in accordance with claim 19 wherein said variable vane assembly wear sleeve extends circumferentially around said radially inner spindle and has an outer diameter that is smaller than a diameter of said bushing opening.

* * * * *